US009745111B2

(12) United States Patent
Brisard

(10) Patent No.: US 9,745,111 B2
(45) Date of Patent: Aug. 29, 2017

(54) STORAGE DEVICE FOR THE PREVENTION OF OXIDATION

(71) Applicant: Jean Ronald Brisard, Englewood, NJ (US)

(72) Inventor: Jean Ronald Brisard, Englewood, NJ (US)

( * ) Notice: Subject to any disclaimer, the term of this patent is extended or adjusted under 35 U.S.C. 154(b) by 161 days.

(21) Appl. No.: 14/826,797

(22) Filed: Aug. 14, 2015

(65) Prior Publication Data

US 2017/0043919 A1 Feb. 16, 2017

(51) Int. Cl.
*B65D 51/16* (2006.01)
*B65D 25/20* (2006.01)

(52) U.S. Cl.
CPC ..... *B65D 51/1644* (2013.01); *B65D 25/20* (2013.01)

(58) Field of Classification Search
CPC B65D 51/1644; B65D 51/16; B65D 51/1611; B65D 51/1622; B65D 51/1633; B65D 25/20
USPC ..... 220/202, 203.01–203.29, 495.02, 23.91, 220/495.06, 787, 789, 800, 801; 215/50, 215/294–305, 307, 311, 260
See application file for complete search history.

(56) References Cited

U.S. PATENT DOCUMENTS 3,067,908 A * 12/1962 Graham ..... B60K 15/0406 220/203.2
5,564,480 A * 10/1996 Chen ..... B65D 81/2038 141/65
5,732,837 A * 3/1998 Jones ..... B65D 51/1616 215/308
6,035,769 A * 3/2000 Nomura ..... A47J 36/027 219/730
6,491,176 B1 * 12/2002 Schollenberger .. B65D 51/1661 215/307
8,689,994 B2 * 4/2014 Pashcow ..... F16K 31/18 116/109
2015/0014332 A1 * 1/2015 Nishibu ..... F17C 1/02 220/586

* cited by examiner

*Primary Examiner* — Robert J Hicks
*Assistant Examiner* — Kareen Thomas

(57) ABSTRACT

A volumetricly changeable liquid reservoir system comprising a reservoir and one or more one-way air valves and float valves that work cooperatively to allow are to escape from the reservoir without allowing liquid to escape when the reservoir is compressed and further including systems for providing assisted compression.

15 Claims, 11 Drawing Sheets

STORAGE DEVICE FOR THE PREVENTION OF OXIDATION

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD

The present application relates to storage vessels capable of air removal.

BACKGROUND

In a perfect world, a painter would know exactly how much paint is needed for a specific job and the paint retailer would sell the exact amount needed. In the real scenario, the needed paint is estimated and then purchased in various sizes of containers, namely, quart-size, gallon-size or five-gallon size containers, which invariably means that there will be some leftover paint.

This extra paint usually ends up being stored in the original paint cans and is placed on a shelf in the basement or a garage, only to be found unusable when needed for touch-ups because during storage due to the paint hardening, drying out or otherwise deteriorating. The degradation of the paint occurs because anytime an air-curable liquid is stored in a container where air is present, the chemical process of oxidation will cause the gradual curing and subsequent degradation of the paint or liquid.

The problem of stored paint degradation due to improper storage has been recognized for some time. For example, in U.S. Pat. No. 925,447, Gunderson, discloses the use of a vapor barrier where the membrane of the vapor barrier is laid on top of the paint to create a seal inside the paint can. Another concept is disclosed in U.S. patent application Ser. No. 09/643,425, Alvarez, that uses a series of quart bottles to store leftover paint.

There remain many shortcomings in the efficacy of these methods used to store and access the leftover paint. In Gunderson, the membrane of the vapor barrier must fit perfectly along the perimeter of the container in order to create an effective seal between the paint and the surrounding air. In Alvarez, the stored paint could be potentially exposed to ambient air if the bottle is not completely full, which results in the premature degradation of the stored paint.

However, the problems associated with oxidation of materials is not only limited to paint. Air is the enemy of many substances such as wine, cooking oils, and perfumes.

Therefore, there continues to be a need for the ability to effectively remove air from a storage container in order to prevent/minimize the amount of oxidation occurring within the container.

SUMMARY

In order to overcome the deficiencies in the prior art, systems and methods are described herein.

One aspect of the claimed invention involves a reservoir capable of constraining liquids that is comprised of at least one or more pathways for air to escape from the reservoir and at least one or more one-way air valves configured to allow air to flow in one direction, which is to escape from the reservoir, and wherein the one direction is to escape out one or more of the pathways when the reservoir is compressed; and one or more float valves configured to work cooperatively with the at least one or more one-way air valves in order to allow air to escape out the one or more pathways but to seal the one or more pathways once substantially all the air is removed from the reservoir.

Another aspect involves a system for removing the air from a bladder comprising a bladder; a fixed plate; a moveable plate with at least one or more opening running through it, one or more threaded drive mechanisms that protrude from the fixed plate and that run through the opening of the movable plate; and one or more rotation stabilizers that are configured to resist the torsion produced in the moveable plate when one or more threaded drive mechanism is rotated in order to cause the moveable plate to move in a direction that will cause compression to be applied to the bladder.

These and other aspects described herein present in the claims result in features and/or can provide advantages over current technology.

The advantages and features described herein are a few of the many advantages and features available from representative embodiments and are presented only to assist in understanding the invention. It should be understood that they are not to be considered limitations on the invention as defined by the claims, or limitations on equivalents to the claims. For instance, some of these advantages or features are mutually exclusive or contradictory, in that they cannot be simultaneously present in a single embodiment. Similarly, some advantages are applicable to one aspect of the invention, and inapplicable to others. Thus, the elaborated features and advantages should not be considered dispositive in determining equivalence. Additional features and advantages of the invention will become apparent in the following description, from the drawings, and from the claims.

DETAILED DESCRIPTION

The instant devices and approach provide a way to remove air from a storage vessel/container/device. The approach is to use a volumetrically changeable liquid reservoir (vessel/container/device) that comprises at least one pathway for air to escape and at least one one-way air valve and at least one float valve. The at least one one-way air valve and at least one float valve are configured to work cooperatively in order to allow air to escape out the pathway when the liquid reservoir is compressed but to seal the pathway once substantially all the air is removed from the reservoir.

As there are numerous ways to implement this approach that range from manual compression by a user to fully automated, some representative examples will now be presented.

Figure 1A:
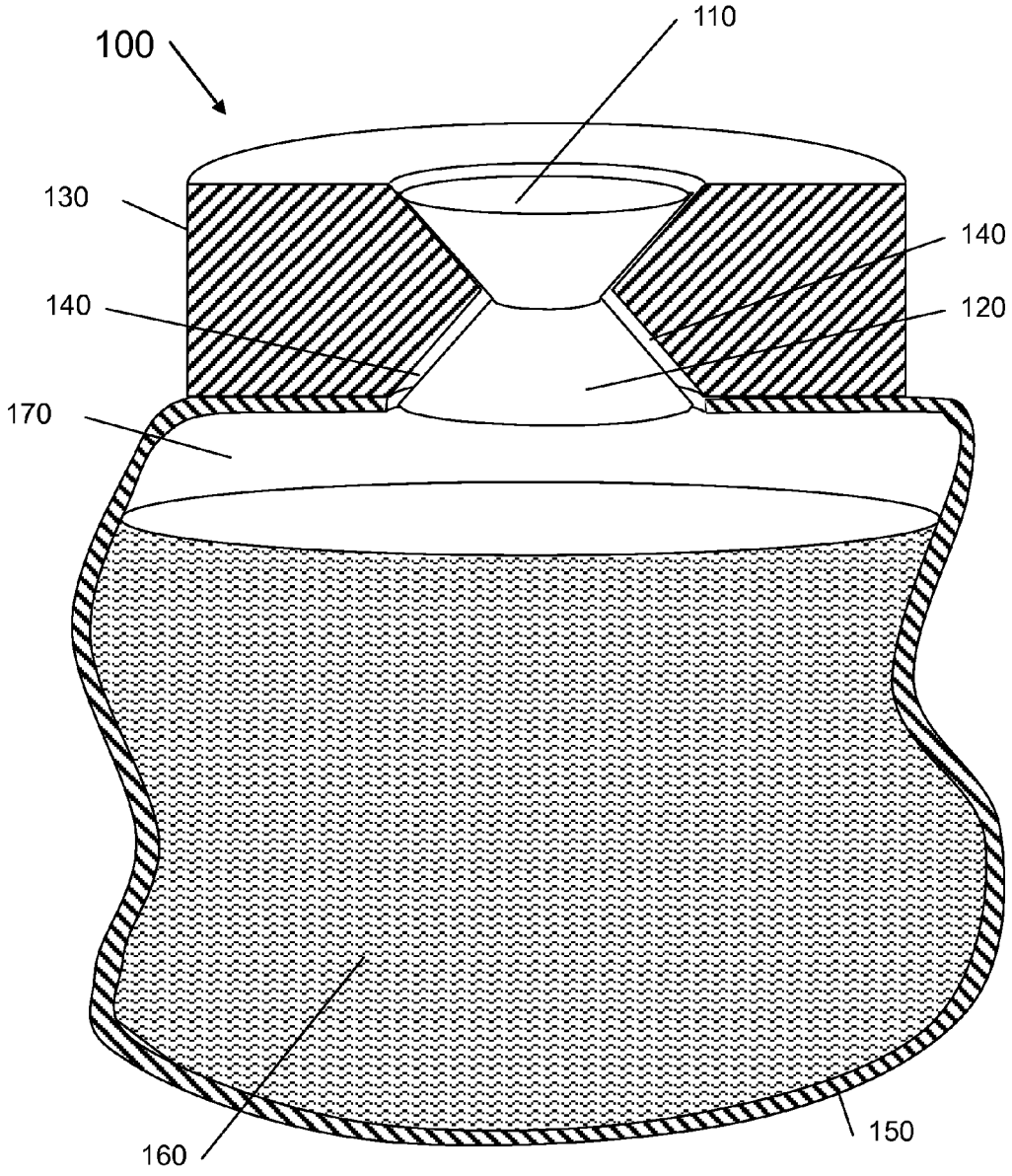
FIG. 1A shows, in simplified form, a liquid reservoir with a one-way air valve and a float valve.

FIG. 1A shows, in simplified form, a liquid reservoir 100 with a one-way air valve and a float valve. Specifically it shows the liquid reservoir 100 including a one-way air valve component 110 and a float valve component 120 that in this case are combined together to form a single component. The valve compenents 110,120 are constrained within a valve housing 130 that creates a pathway 140, which is shown as currently sealed by the air valve component 110, which in this example is gravity activated. The valve housing 130 is attached to a bladder 150 that constrains a volume of liquid 160 and a volume of air 170 above the liquid. Additionally, the liquid reservoir 100 may contain a separate aperture (not shown) for filling and removing the liquid 160 from the bladder.

Figure 1B:
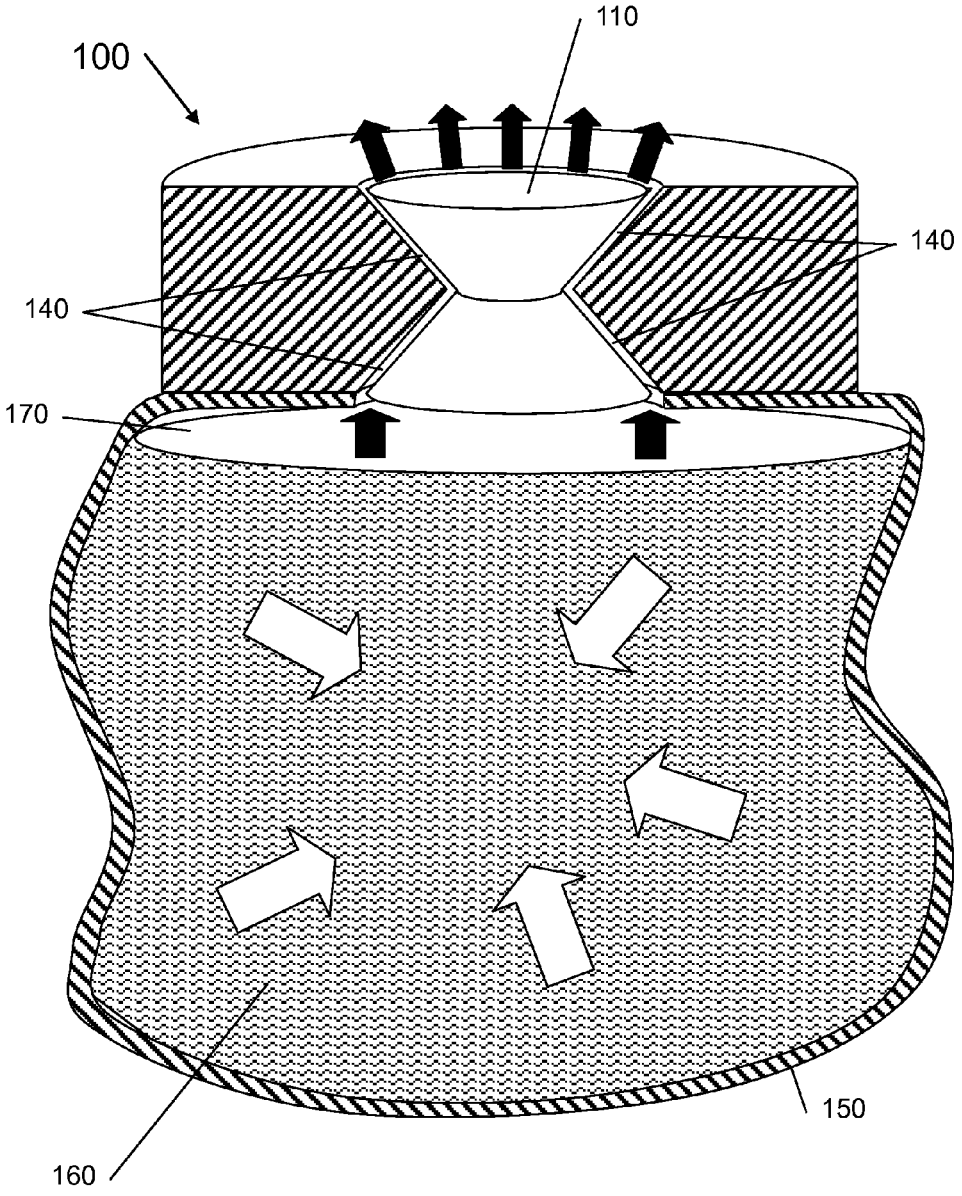
FIG. 1B shows, in simplified form, the same liquid reservoir beginning to be compressed.

FIG. 1B shows, in simplified form, the same liquid reservoir 100 beginning to be compressed, indicated by the white arrows. As the bladder 150 is compressed the volume of liquid 160 remains constant but the volume of air 170 decreases. A decrease in the air 170 occurs when the air pressure applied to the one-way air valve 110 is sufficient cause the air valve 110 to rise against gravity, such that the pathway 140 is no longer blocked and air is allowed to escape from the liquid reservoir 100, as indicated by the black arrows.

Figure 1C:
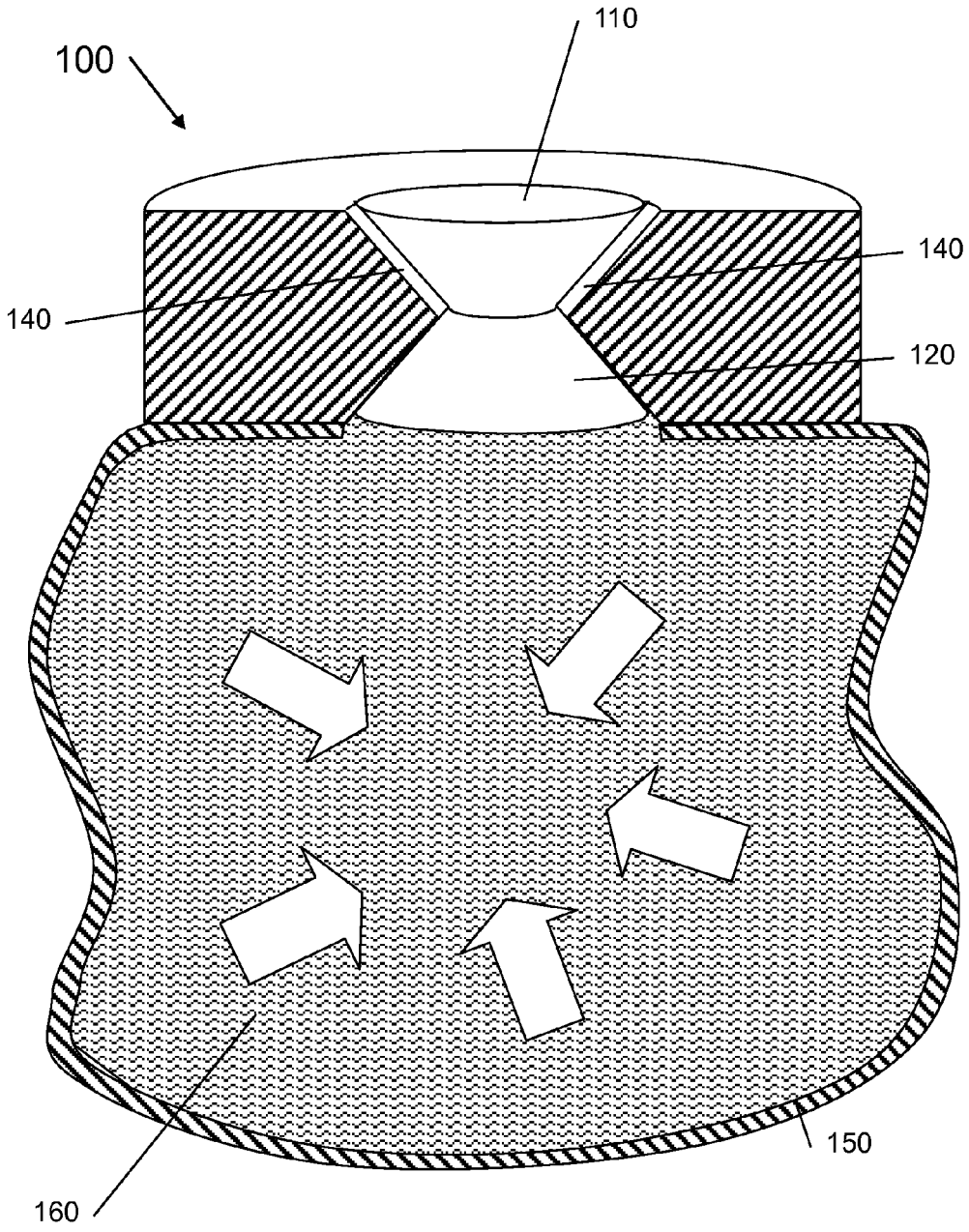
FIG. 1C shows, in simplified form, the same liquid reservoir fully compressed such that substantially all of the air has exited.

FIG. 1C shows, in simplified form, the same liquid reservoir 100 fully compressed such that substantially all of the air has exited. As more and more air exits from the bladder 150, due to the compression on the bladder 150, eventually the liquid 160 will cause the float valve component 120 to rise and seal off the pathway 140 and prevent any liquid 160 from exiting out the pathway 140, regardless of additional compression being applied. [Note: as the compression on the bladder is released, a small amount of air may reenter the bladder 150 prior to the one-way air valve component 110 reengaging and blocking the pathway 140.]

Having explained the basic functioning of how a one-way air valve and float valve work cooperatively in order to allow air to escape out a pathway when the liquid reservoir is compressed but to seal the pathway once substantially all the air is removed from the reservoir, a few alternative representations will now be presented.

Figure 2:
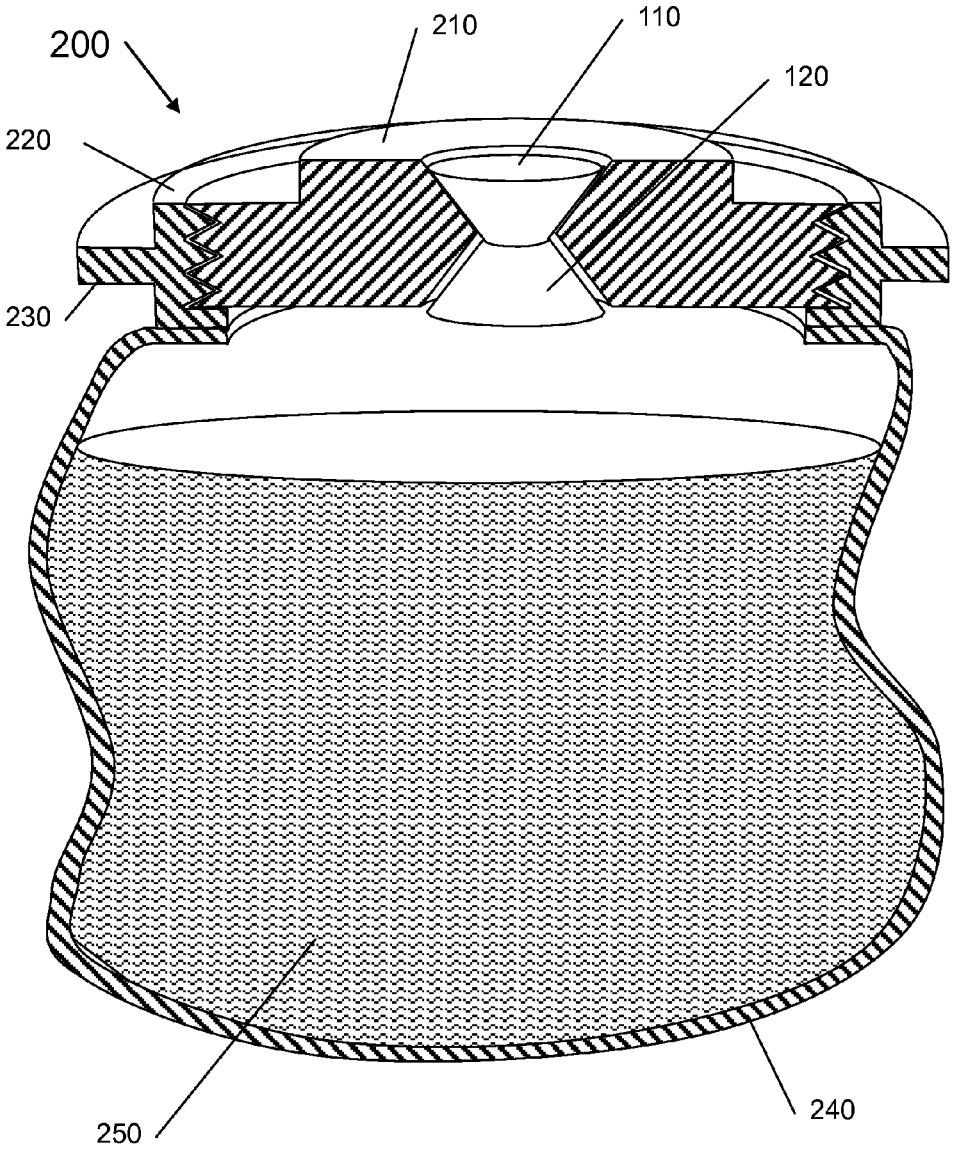
FIG. 2 shows, in simplified form, a liquid reservoir with a one-way air valve and a float valve incorporated into a plug.

In FIG. 2 it shows, in simplified form, a liquid reservoir 200 with a one-way air valve and a float valve incorporated into a plug 120, which in this case happens to be threaded but could just as easily have functioned like a stopper/cork, especially if the liquid reservoir was in the shape of a bottle.

In FIG. 2, the one-way air valve and float valve incorporated into a plug 120 use the same combined one-way air valve component 110 and float valve component 120 from FIG. 1A-C and the functioning is the same. The plug 210 is inserted into a housing 220 (which in this case has mating threads). The housing 220 has a support flange 230 and is attached to a bladder 240, which constrains a volume of liquid 250.

FIGS. 1A-C and 2 have used the same combined one-way air valve and float valve. However, with a simple change in the housing configuration a sphere can be utilized to also produce a combined one-way air valve and float valve.

Figure 3:
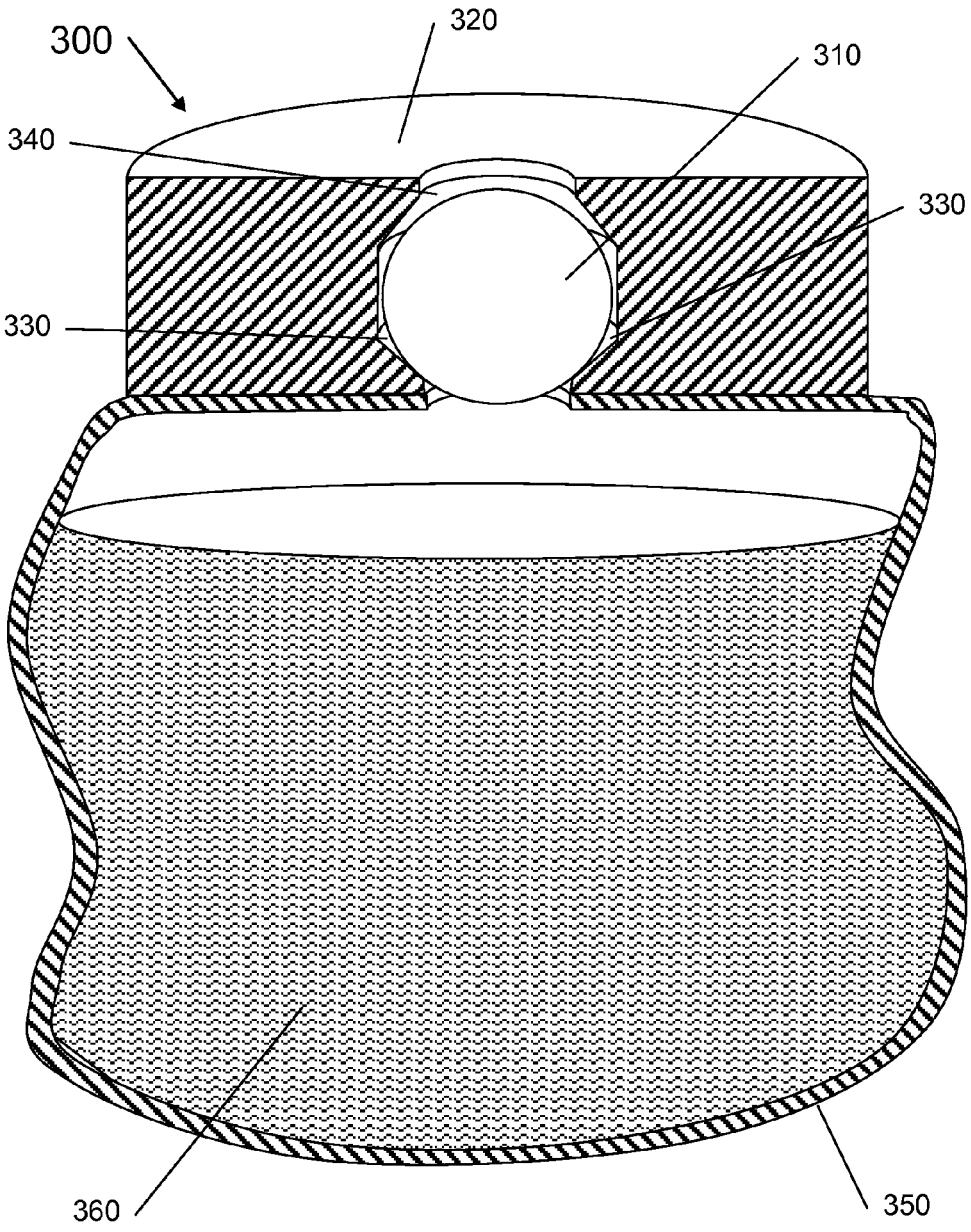
FIG. 3 shows, in simplified form, the use of a sphere in creating a combined one-way air valve and float valve.

FIG. 3 shows, in simplified form, the use of a sphere in creating a combined one-way air valve and float valve. In FIG. 3 we see an alternate liquid reservoir 300 with a sphere 310 constrained within a housing 320. The housing 320 is attached to a bladder 350 that constrains a volume of liquid 360. Additionally, the housing 320 has a one-way are valve surface 330, which engages with the sphere due to gravity and only allows air to escape when the bladder is compressed, and a float valve surface 340 that engages with the sphere when the liquid 360 forces the sphere against it.

Another typical application is to incorporate the valves into a cap. The incorporation of a one-way air valve and float valve into a cap, will be illustrated with the version represented in FIG. 3 but just as easily could have been done with FIG. 1A or any of the other variations to be presented. As such, FIG. 4 shows, in simplified form, the use of a sphere in creating a combined one-way air valve and float valve as part of a cap.

Figure 4:
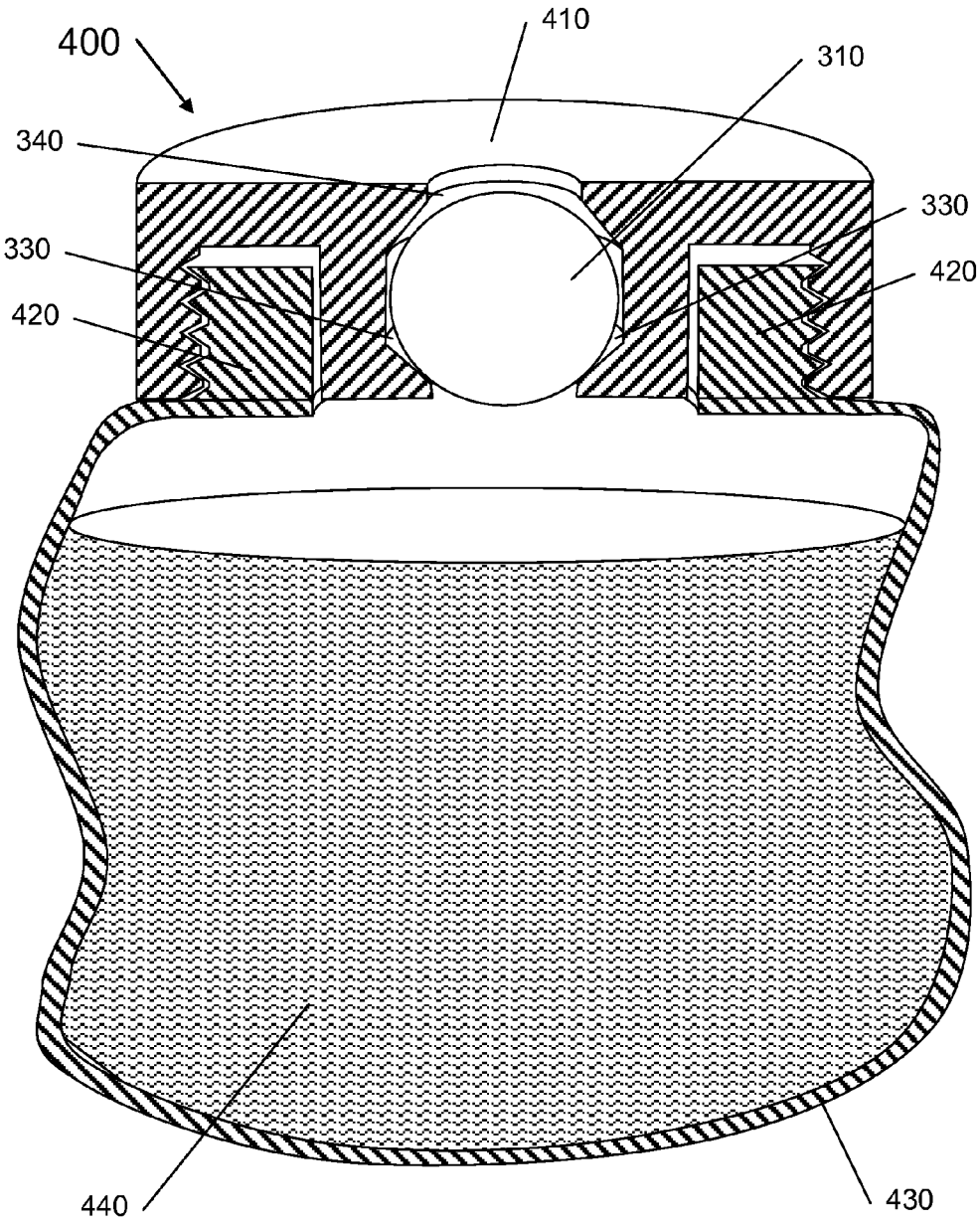
FIG. 4 shows, in simplified form, the use of a sphere in creating a combined one-way air valve and float valve as part of a cap.

In FIG. 4 we see a liquid reservoir 400 with the sphere 310 constrained within a cap 410. The cap 410 has the same one-way are valve surface 330 and float valve surface 340 (from FIG. 3) and the cap engages with a housing 420 (using mating threads). The housing 420 is similarly attached to a bladder 430 that constrains a volume of liquid 440.

Figure 5:
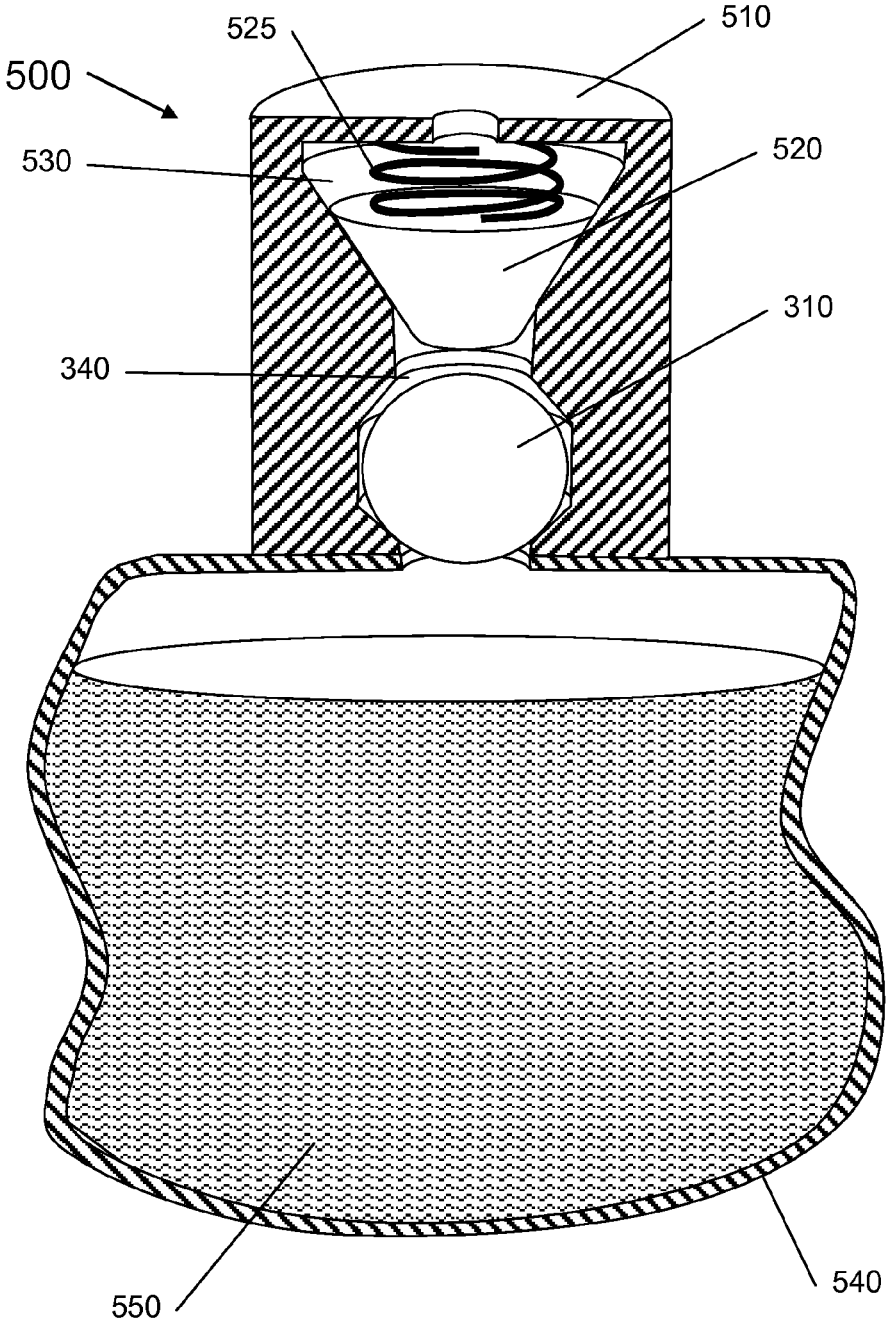
FIG. 5 shows, in simplified form, a one-way air valve with a closing load.

So far, we have discussed the one-way air valves using gravity to keep them closed. However, in is often advantageous to provide a closing load, which keeps the one-way air valve closed until the pressure applied to the one-way air valve exceeds the predetermined closing load. FIG. 5 shows, in simplified form, a one-way air valve with a closing load.

In FIG. 5 we see a liquid reservoir 500 with a separate one-way air valve 520 and a separate float valve component/sphere 310 both of which are constrained within a housing 510. The housing 510 is attached to a bladder 540 that constrains a liquid 550. In order for air to escape out of bladder 540, the air pressure on the one-way air valve component 520 (resulting from compression of the bladder 540) must exceed the closing load produced in this example by a spring 525. The spring 525 forces the one-way air valve component 520 to engage with one-way air valve surface 530 in order to block the airflow pathway. In addition to the one-way air valve surface 530, the housing 510 comprises a float valve surface 340 that engages with the sphere 310 when the liquid 550 forces the sphere against it.

At this point, it is worth noting that FIG. 1A-C and 2-5 have presented just a few of the possible configurations for one-way air valves and float valves. The importance being that the valves work cooperatively in order to allow air to escape but keep the liquid inside the reservoir and not the particular configuration.

Further, up to this point, the bladders have all been represented as free standing. However, often it is advantageous to incorporate them into an outer container. As such, a few representative examples will now be presented using, for illustration purposes, the liquid reservoirs from FIGS. 2 and 4.

Figure 6:
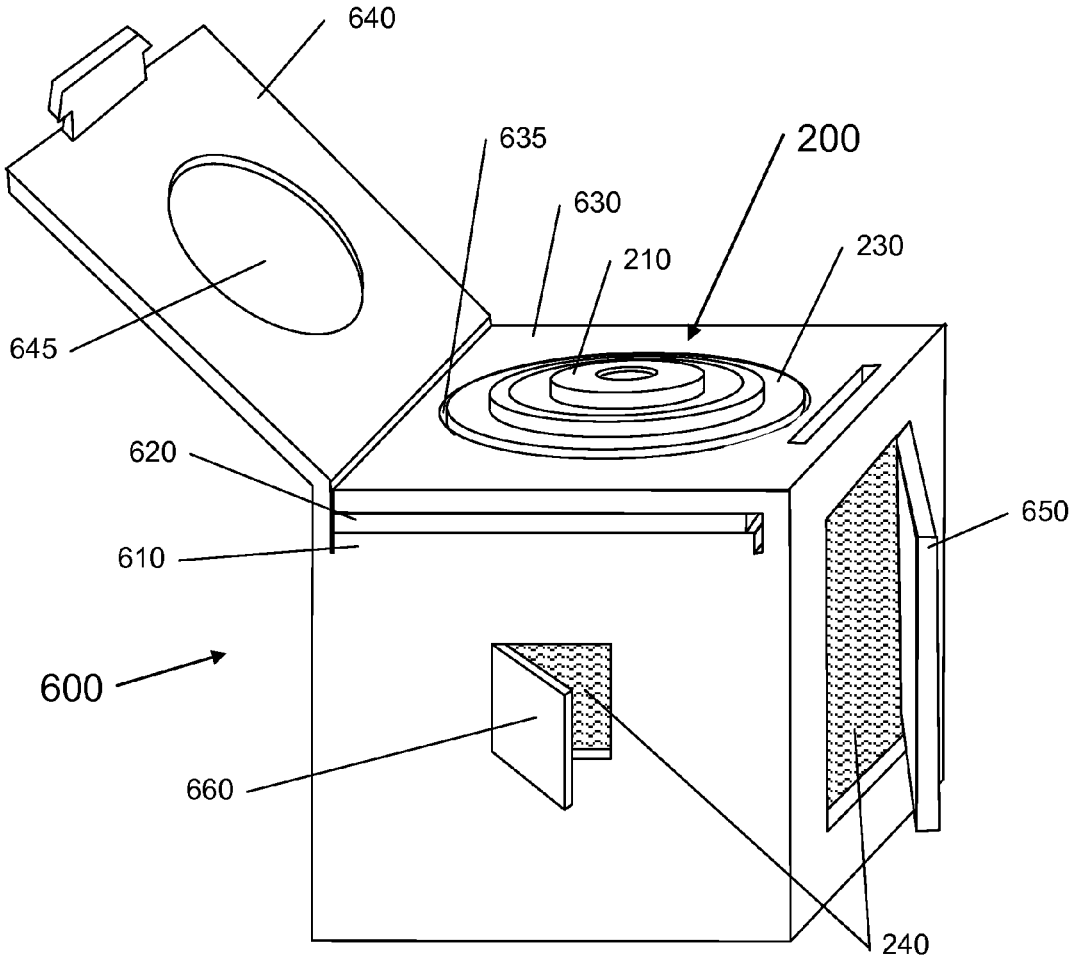
FIG. 6 shows, in simplified form, the liquid reservoir from FIG. 2 incorporated into a box.

FIG. 6 shows, in simplified form, the liquid reservoir 200 from FIG. 2 incorporated into a box 600. The box 600 is representative of a foldable design of which there are numerous possibilities. Box 600 is represented as a box in the process of being closed, where the first three flaps 610, 620, 630 associated with the top of the box have been folded in place and the final flap 640 is ready to be closed. The bottom two flaps have a opening (not shown) that is configured to be smaller than the support flange 230 of the liquid reservoir 200 such that the flange 230 rests on top of the first two flaps 610,620 but still allows the bladder 240 to be inserted into the box. The third flap 630 has an opening 635 that is bigger than the support flange 230 and designed to nest the support flange 230. The final flap 640 has an opening 645 that is smaller than the support flange 230 and designed to capture the liquid reservoir 200 when the final flap is closed while still allowing the plug 210 to be removed.

Additionally, FIG. 6, has one or more openings 650 that allow the bladder 240 to be compressed, while a hinged opening is advantageous because it protects the liquid within the bladder 240 from light, removable and simply openings of sufficient size to allow compression of the bladder are also anticipated. Also shown is a smaller/optional visualization flap 660.

Figure 7:
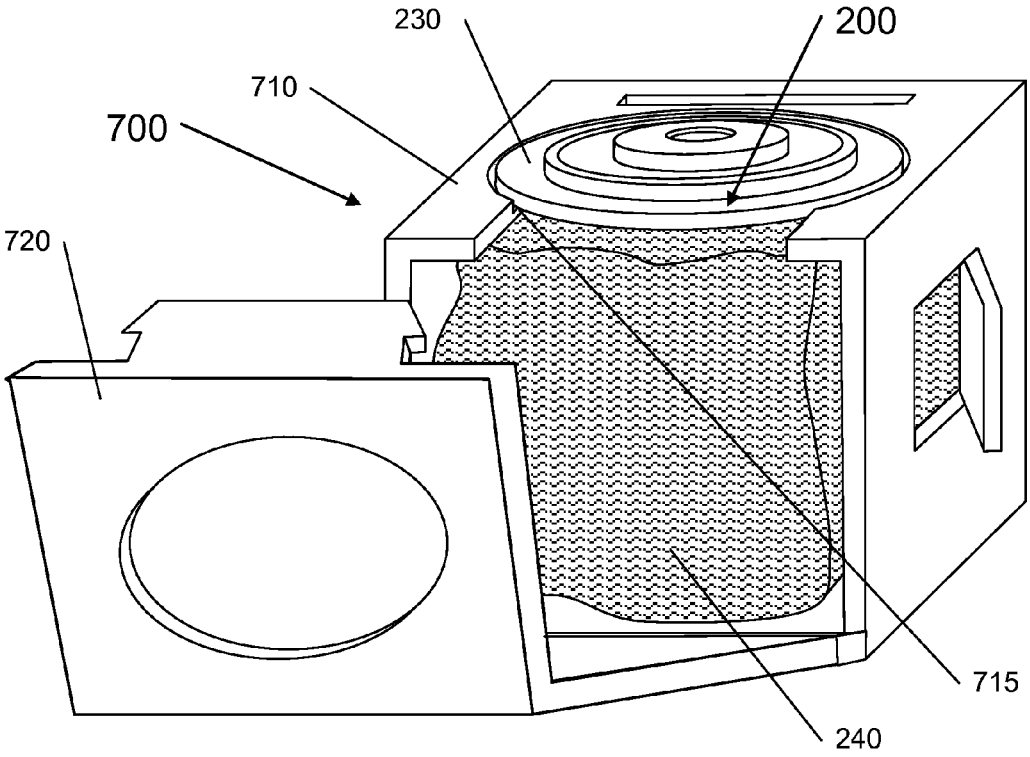
FIG. 7 shows, in simplified form, an alternative box design.

FIG. 7 shows, in simplified form, an alternative box design. However, instead of incorporating the nesting of support flange 230 of the liquid reservoir 200 into the flaps, it incorporates it into the top 710 of box 700. The top 710 of the box 700 has an undercut 715, which the support flange 230 rests on. The support flange is also captured by closing the combination side/top flap 720, which also provides access to the bladder 240 when opened.

With any of the liquid reservoirs present so far, compression of a liquid reservoir can either be manually, where compression is applied directly to the liquid reservoir or assisted where the pressure is applied indirectly to the liquid reservoir.

A good example of indirect pressure being applied, is specified in FIG. 1-7 of US 20140224808 A1, also by Jean Ronald Brisard (the present author). [Note: US 20140224808 A1 is hereby incorporated by reference.] By replacing the filler cap (specified as component 96 in FIGS. 1, 3 and 4) with an appropriately sized/configured cap 410, inclusive of sphere 310, then an assisted volumetrically changeable liquid reservoir that comprises at least one pathway for air to escape and at least one one-way air valve and at least one float valve configured to work cooperatively is created.

Figure 8:
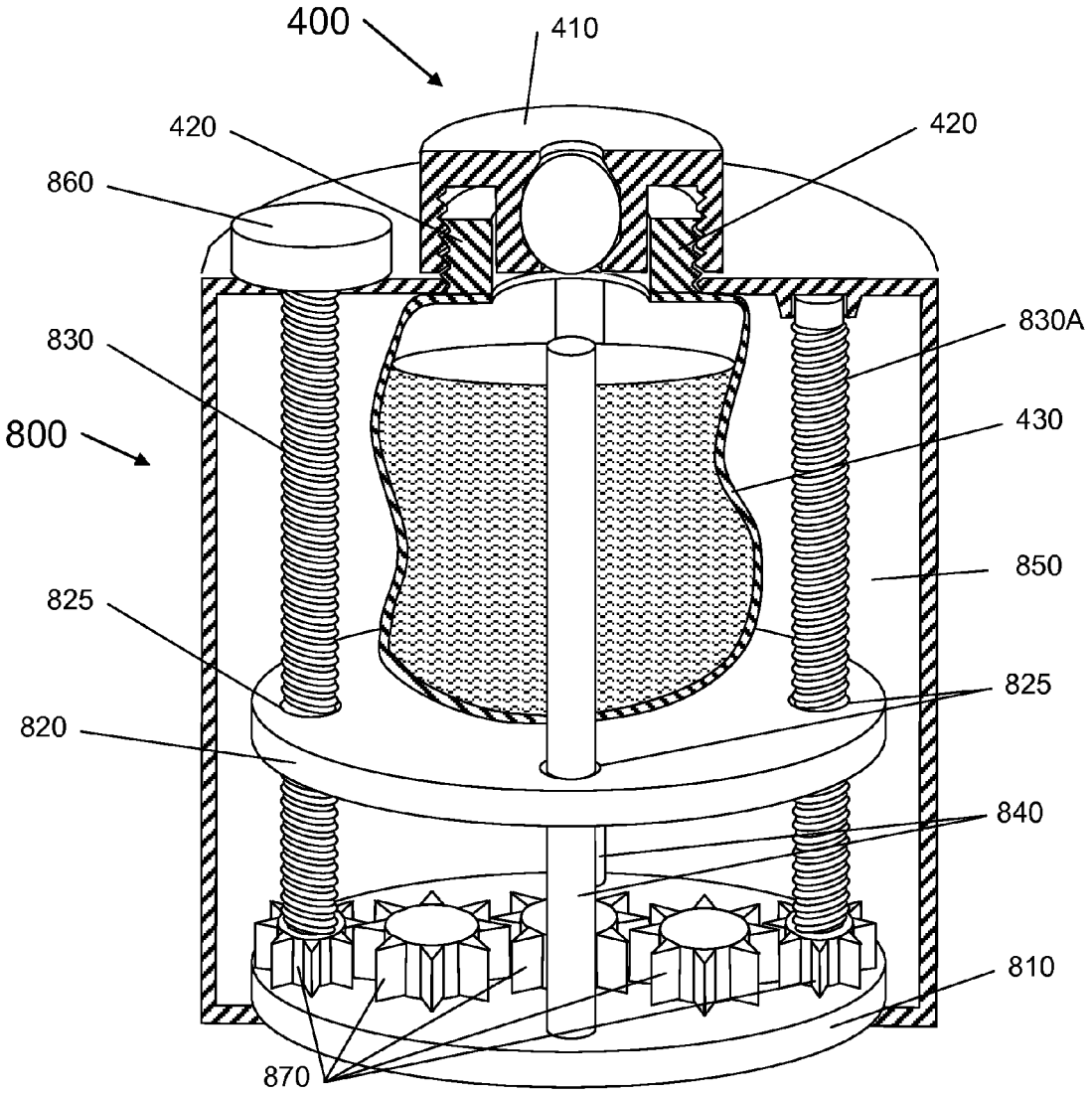
FIG. 8 shows in simplified form, an alternative means of lifting a plate to provide compression.

In US 20140224808 A1 a plate is manually lifted in order to provide compression and there are numerous ways that this can be accomplished. FIG. 8 shows in simplified form, an alternative means of lifting a plate to provide compression.

In FIG. 8 we see a representative system for assisted removal of air from a bladder 430 of a liquid reservoir 400. The housing 420 has been attached (in this case threaded) to storage container 800. The storage container 800 comprises a fixed plate 810 that can either be a separate plate as shown or incorporated into the bottom of the container; a moveable plate 820 with at least one or more opening 825 running through it, wherein at least one of the openings is a threaded opening; a threaded drive mechanism 830 that is inserted into the threaded opening 825 of the movable plate 820 and protruding from the fixed plate 810; one or more rotation stabilizers that are also protruding from the fixed plate 810 and running through an opening in the movable plate 820 such that when the first threaded drive mechanism 830 is rotated the moveable plate 820 moves towards/away the fixed plate 810 depending on the direction of rotation. In use, when the moveable plate 820 is moving away from the fixed plate it is configured to provide a compressive force to the bladder 430.

[Note: An additional refinement is that the storage container 500 does not necessarily need to contain any physical rotation stabilizers 840. The physical rotation stabilizers 840 are configured to resist the torsion produced by the threaded drive mechanism 830 on the moveable plate 820 in order to cause the moveable plate 820 to move towards/away the fixed plate 810. However, if there are no physical rotation stabilizers then the torsion produced by the first threaded drive mechanism 830 on the moveable plate 820 will be resisted by the moveable plate 820 coming into contact with the inside 850 of storage container 800, which is another form of rotation stabilizer, and the movable plate 820 will still move up/down.]

In this example, the first threaded drive mechanism 830 is intended to be turned by hand using knob 860, but could just have easily been driven by a motor. Shown in FIG. 8 is also a second threaded drive mechanism 830A, which in this example has threads running in the opposite direction and is interconnected through one or more drive connectors 870, configured to transmit motion. The drive connectors 870 are represented as an odd number of gears necessitating that the first threaded drive mechanism 830 and the second threaded drive mechanism 830A to have threads running in the opposite direction. Had it been an even number of gears (or for example a belt or chain driven) causing the two threaded drives 830,835 to rotate in the same, rather than the opposite direction, then the threads would by necessity have to be in the same direction. [It should be noted that a second threaded drive mechanism also acts as a rotational stabilizer regardless of the direction of rotation.]

It is also worth noting that the storage container 800 with simply a compressible bladder attached to the container using the housing 420 is useful even with a standard cap (e.g. no valves). However, in this case there is nothing to prevent the liquid from overflowing if too much compression is applied.

Figure 9:
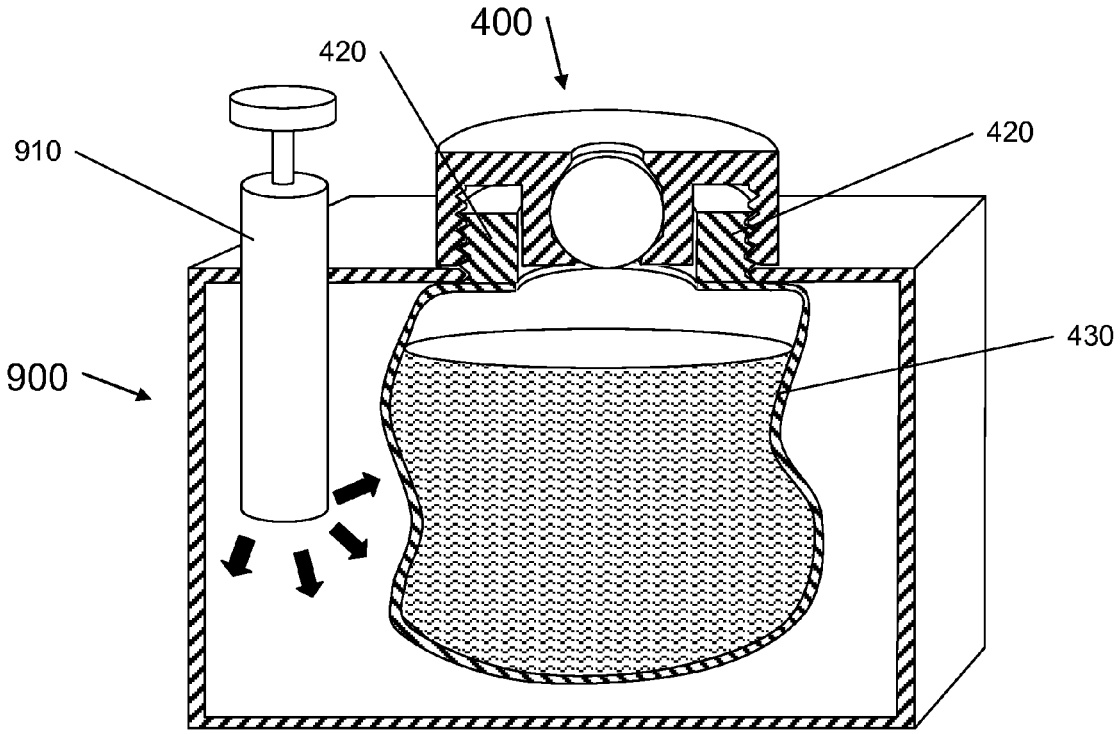
FIG. 9 shows, in simplified form, the use external compression to the bladder of a liquid reservoir.

While moving plates coming from either the bottom, top or sides are useful for applying compression, they are not the only form of applying compression. For example, if the bladder of liquid reservoir is placed inside a sealed system then pressurized fluids (e.g. air) can be used to supply an external compression. FIG. 9 shows, in simplified form, the use external compression to the bladder 430 of a liquid reservoir 400.

In FIG. 9 we see that we see that the housing 420 has been attached (in this case threaded) to storage container 900, which is presumed to now be an airtight system. Storage container 900 also includes an air pump 910 capable of pumping air into the storage container 900 in order that the air pressure will produce a compressive load on the bladder 430.

The embodiments presented have many applications from industrial substances (such as paint and oil stored in drums), food products (such as wine or cooking oil), medical substances (such as blood or serum), and/or commercial substances (such as perfume or scented oils).

Finally, it is to be understood that various different variants of the invention, including representative embodiments and extensions have been presented to assist in understanding the invention. It should be understood that such implementations are not to be considered limitations on either the invention or equivalents except to the extent they are expressly in the claims. It should therefore be understood that, for the convenience of the reader, the above description has only focused on a representative sample of all possible embodiments, a sample that teaches the principles of the invention. The description has not attempted to exhaustively enumerate all possible permutations, combinations or variations of the invention, since others will necessarily arise out of combining aspects of different variants described herein to form new variants, through the use of particular hardware or software, or through specific types of applications in which the invention can be used. That alternate embodiments may not have been presented for a specific portion of the description, or that further undescribed alternate or variant embodiments may be available for a portion of the invention, is not to be considered a disclaimer of those alternate or variant embodiments to the extent they also incorporate the minimum essential aspects of the invention, as claimed in the appended claims, or an equivalent thereof.

What is claimed:

1. A volumetricly changeable liquid reservoir system comprising:

a reservoir configured to constrain a liquid, at least one or more pathways for air to escape from the reservoir;

at least one or more one-way air valves configured to allow air to flow in one direction, wherein the one direction is to escape out one or more of the pathways when the reservoir is compressed;

at least one or more float valves configured to work cooperatively with the at least one or more one-way air valves in order to allow air to escape out the one or more pathways but to seal the one or more pathways once substantially all the air is removed from the reservoir; and an outer container configured to support the reservoir and wherein the outer container is a foldable box and wherein the box is configured to allow access by a user in order to apply a compressive force to the reservoir.

2. The system of claim 1 wherein at least one of the at least one or more one-way air valves and at least one of the at least one or more float valves are incorporated into a plug.

3. The system of claim 1 wherein at least one of the at least one or more one-way air valves and at least one of the at least one or more float valves are incorporated into a cap.

4. The system of claim 1 further comprising a closing load configured to cause air pressure to be applied to the least one or more one-way air valves to exceed a predetermined value prior to air being allowed to escape from the reservoir.

5. The system of claim 1 where the outer container is configured to be airtight once the reservoir is inserted into it and where in the outer container further comprises an air pump, pumping air into inside the outer container in order to produce a compressive load on the reservoir.

6. A volumetricly changeable liquid reservoir system comprising:

a reservoir configured to constrain a liquid, at least one or more pathways for air to escape from the reservoir;

at least one or more one-way air valves configured to allow air to flow in one direction, wherein the one direction is to escape out one or more of the pathways when the reservoir is compressed;

at least one or more float valves configured to work cooperatively with the at least one or more one-way air valves in order to allow air to escape out the one or more pathways but to seal the one or more pathways once substantially all the air is removed from the reservoir; and an outer container configured to support the reservoir and wherein the outer container further comprising a movable plate configured to move in a direction that provides compression to be applied to the reservoir.

7. The system of claim 6 wherein the moveable plate has at least one or more openings running through it, wherein at least one of the openings is a first threaded opening and wherein the outer container further comprises:

a fixed plate;

a first threaded drive mechanism that is inserted into the threaded opening of the movable plate and protruding from the fixed plate; and one or more rotation stabilizers that are configured to resist torsional forces produced in the moveable plate when the first threaded drive mechanism is rotated in order to cause the moveable plate to move in a direction that will cause compression.

8. The system of claim 7 wherein the moveable plate contains at least two openings and at least one of the one or more rotation stabilizers are protruding from the fixed plate and running through a second opening in the movable plate.

9. The system of claim 8 where at least one of the one or more of the rotation stabilizers is a second threaded drive mechanism and the second opening is a second threaded opening.

10. The system of claim 9 further comprises one or more drive connectors configured to transmit motion between the first and second threaded drive mechanisms and wherein the first and second threaded drive mechanisms rotate in the same direction.

11. The system of claim 9 further comprises one or more drive connectors configured to transmit motion between the first and second threaded drive mechanisms and wherein the first and second threaded drive mechanisms rotate in the opposite direction.

12. The system of claim 6 where the outer container is an oil drum.

13. The system of claim 6 where the outer container is a bottle.

14. A volumetricly changeable liquid reservoir system comprising:

a reservoir configured to constrain a liquid, at least one or more pathways for air to escape from the reservoir;

at least one or more one-way air valves configured to allow air to flow in one direction, wherein the one direction is to escape out one or more of the pathways when the reservoir is compressed;

at least one or more float valves configured to work cooperatively with the at least one or more one-way air valves in order to allow air to escape out the one or more pathways but to seal the one or more pathways once substantially all the air is removed from the reservoir; and an outer container configured to support the reservoir and where the outer container is configured to be airtight once the reservoir is inserted into it and where in the outer container further comprises an air pump, pumping air into inside the outer container in order to produce a compressive load on the reservoir.

15. The system of claim 6 where the outer container is configured to be airtight once the reservoir is inserted into it and where in the outer container further comprises an air pump, pumping air into inside the outer container in order to produce a compressive load on the reservoir.

* * * * *